United States Patent [19]

Ewald et al.

[11] Patent Number: 4,566,945

[45] Date of Patent: Jan. 28, 1986

[54] HEADBOX TRAILING ELEMENT

[75] Inventors: James L. Ewald, Beloit, Wis.; José J. A. Rodal, Rockton, Ill.

[73] Assignee: Beloit Corporation, Beloit, Wis.

[21] Appl. No.: 598,968

[22] Filed: Apr. 11, 1984

[51] Int. Cl.[4] ..... D21F 1/06; D21F 1/02

[52] U.S. Cl. ..... 162/343; 162/336; 162/344

[58] Field of Search ..... 162/343, 336, 341, 344, 162/347; 428/113, 902

[56] References Cited

U.S. PATENT DOCUMENTS

| | | | |
|---|---|---|---|
| Re. 28,269 | 12/1974 | Hill et al. | 162/343 |
| 3,843,470 | 10/1974 | Betley et al. | 162/336 |
| 4,051,289 | 9/1977 | Adamson | 428/113 |
| 4,128,455 | 12/1978 | Justus | 162/343 |
| 4,133,715 | 1/1979 | Hergert | 162/343 |
| 4,173,670 | 11/1979 | Van Auken | 428/111 |
| 4,331,723 | 5/1982 | Hamm | 428/113 |

*Primary Examiner*—S. Leon Bashore
*Assistant Examiner*—K. M. Hastings
*Attorney, Agent, or Firm*—Hill, Van Santen, Steadman & Simpson

[57] ABSTRACT

A paper machine trailing element for use in a slice in a headbox wherein the trailing element is formed of laminations with a bead at the upper end for anchoring the element in a slice chamber with the bead formed of laminations with fibers on the outer surface in the machine direction and in the cross-machine direction within the bead so that the element has a greater stiffness in the machine direction at the upstream end with the element tapering to a thin tip at the downstream end and the downstream end formed of laminations with fibers extending in the cross-machine direction for a greater stiffness to minimize instability.

17 Claims, 3 Drawing Figures

HEADBOX TRAILING ELEMENT

BACKGROUND OF THE INVENTION

The invention relates to improvements in paper machine headboxes, and more particularly to improvements in headbox slice chambers and to an improved trailing element which extends freely toward the slice opening and is anchored at the upstream end for being self-positionable and for maintaining fine scale turbulence in the stock at the slice opening.

The present invention is an improvement in our invention disclosed and taught in our co-pending application, Ser. No. 555,158, filed Nov. 25, 1983, the contents and disclosure of which are incorporated herein by reference.

The concept of a freely movable self-positionable trailing element in a slice chamber of a headbox was first disclosed in U.S. Pat. No. 3,939,037, Hill. In a further application, U.S. Pat. No. Re. 28,269, Hill et al, trailing elements are disclosed extending from pondside to pondside. These trailing elements are capable of generating or maintaining fine scale tubulence in the paper stock flowing toward and through the slice opening. The concepts of the foregoing patents may also be employed to utilize their advantage and to function in the machine for making multi-ply paper wherein stocks of different characteristics are fed to chambers on opposite sides of the trailing elements where the elements extend from pondside to pondside.

A limitation in the headbox design utilizing the features of the foregoing patents has been that the means for generating turbulence in fiber suspension in order to disperse the fibers has been only comparative large scale devices. With such devices, it is possible to develop small scale turbulence by increasing the intensity of the turbulence generated. Thus, the turbulent energy is transferred naturally from large to small scale, and the higher the intensity, the greater the rate of energy transfer and hence, the smaller the scale of turbulence sustained. However, a detrimental effect also ensues from this high intensity large scale turbulence, namely, the large waves and free surface disturbance developed on the fourdrinier table. Thus, a general rule of headbox performance has been that the degree of dispersion and level of turbulence in the headbox discharge was closely correlated, i.e., the higher the turbulence, the better the dispersion.

In selecting a headbox design under this limiting condition then, one could choose at the extreme, either a design that produces a highly turbulent well dispersed discharge, or one that disperses a low turbulent, poor dispersed discharge. Since either a very large level of tubulence or a very low level (and consequent poor dispersion) produced defects in sheet formation on the fourdrinier machine, the art of the headbox design has consisted of making a suitable compromise between these two extremes. That is, a primary objective of the headbox design up to the time of developments of the self-positionable element has been to generate a level of turbulence which was high enough for dispersion, but low enough to avoid free surface defects during the formation period. It will be appreciated that the best compromise would be different for different types of papermaking furnishes, consistencies, fourdrinier table design, machine design, machine speed and the like. Furthermore, because these compromises always sacrifice the best possible dispersion and/or the best possible flow pattern on the fourdrinier wire, it is deemed that there is a great potential for improvement in headbox design today. While reference herein is made to formation on a fourdrinier, it will be understood that the features of the present invention and the discussed defects of the prior art also apply to twin wire formers.

The unique and novel combination of elements of the aforementioned patents provide for delivery of the stock slurry to a forming surface of a papermaking machine having a high degree of fiber dispersion with a low level of turbulence in the discharge jet. Under these conditions, a fine scale dispersion of the fibers is produced which will not deteriorate to the extent that occurs in the turbulent dispersion which is produced by conventional headbox designs. It has been found that it is the absence of large scale turbulence which precludes the gross reflocculation of the fibers since flocculation is predominately a consequence of small scale turbulence decay and the persistence of the large scale turbulence. Sustaining the dispersion in the flow on the fourdrinier wire then leads directly to improved formation.

The method by which the above is accomplished, that is, to produce fine scale turbulence without large scale eddies, is to pass the fiber suspension through a system of parallel cross-machine channels of uniform small size but large in percentage open area. Both of these conditions, uniform small channel size and large exit percentage open area, are necessary. Thus, the larger scales of turbulence developed in the channel flow have the same order of size as the depth of the individual channels by maintaining the individual channel depths small, and the resulting scale of turbulence will be small. It is necessary to have a large exit percentage open area to prevent the development of large scales of turbulence in the zone of discharge. That is, large solid areas between the channels exits would result in large scale turbulence in the wake of these areas.

In concept then, the flow channel must change from a large entrance to a small exit size. This change should occur over a substantial distance to allow time for the large scale coarse flow disturbances generated in the wake of the entrance structure to be degraded to the small scale turbulence desired. The area between channels approaches the dimension that it must have at the exit end. This concept of simultaneous convergence is an important concept of design. This concept is employed in accordance with the teachings of our previous application referred to above, and a trailing element is provided which has further improved features.

Under certain operating conditions, the trailing members which are employed to obtain the fine scale turbulence are not necessarily stable. Cross-machine transient pressures tend to bend the trailing element in a cross-machine direction and cause cross-machine uniformity variances in the paper. Resistance to deformation along the machine direction length of the trailing elements can cause slight digressions in the uniform velocity of the stock flowing off the surfaces at the trailing edge of the trailing element. Static or dynamic instability can occur at certain operating conditions and resonant frequencies can be reached dependent on the hydrodynamic forces. It has been discovered that the inertia and hydrodynamic couplings can be broken by suitable distribution of the mass and elasticity of the trailing structure with the proper mass distribution and stiffness distribution being of importance.

It is accordingly an object of the invention to provide an improved trailing element design which avoids the disadvantages that occur at certain operating conditions in structures heretofore available. It is particularly an objective to provide a trailing element which has different flexure physical qualities from the upstream end to the downstream end, and these are obtained by lamination construction. As used herein, machine direction will refer to the flow direction of the stock in flowing through the headbox, and cross-machine direction is the direction at right angles thereto. Isotropic means having the same properties in all directions, and anisotropic means not isotropic, that is, exhibiting different properties when tested along axes in different directions.

In accordance with the principles of the invention, objectives of the design are attained by providing a self-positionable trailing element which has a greater structural stiffness in a machine direction at the upstream or mounting end, and a greater structural stiffness in the cross-machine direction at the downstream or trailing end. In a preferred form, the element is made of an anisotropic material, preferably one being formed of a laminate with separate layers of the laminate providing the qualities of difference in stiffness and flexibility by either material properties, direction, size or number. Alternates of woven or needled material with weave direction or materials or size or numbers of filaments controlling directional stiffness may be used. Preferably, however, the difference is attained by the use of fibers which are arranged in a machine direction at the upstream end to provide the greater stiffness in the machine direction, and which are arranged in a cross-machine direction at the downstream end to provide for a greater stiffness in the cross-machine direction. A further feature is to provide strength at the supporting bead at the upper end which precludes the chance of adhesive failure and which eliminates the necessity of a joint to avoid cleanliness problems. A filler is added in a single wedge to prevent collapse and a cross-machine direction fiber is utilized inside to minimize cross-machine direction thermal expansion. In the downstream direction, the downstream portion of the trailing element has a dominance of cross-machine direction fibers on the outside of the sheet which maximizes cross-machine direction stiffness to reduce buckling. The dominance of cross-machine fibers on the outer surface as well as the relatively thin dimension of the trailing edge, maximizes cross-machine direction stiffness and minimizes machine direction stiffness for the tip to be able to conform to streamlines putting minimal disturbances in the flow. The thin tip with minimal machine direction stiffness and strength, yet maximized cross-machine stiffness for maximized cross-direction profile stability and minimized flow disturbance reduces eddy generation. This also allows for the use of maximum length sheets with minimum tip gap for maximum formation capability and minimum turbulence, minimum eddy generation and ability to follow streamlines and where used for a multi-ply sheet allows minimum disturbance for formation which contributes to layer purity.

Other objects, advantages and features will become more apparent with the teaching of the principles of the invention in connection with the disclosure of the preferred embodiment in the specification, claims and drawings, in which:

DESCRIPTION OF THE PREFERRED EMBODIMENT

Figure 1:
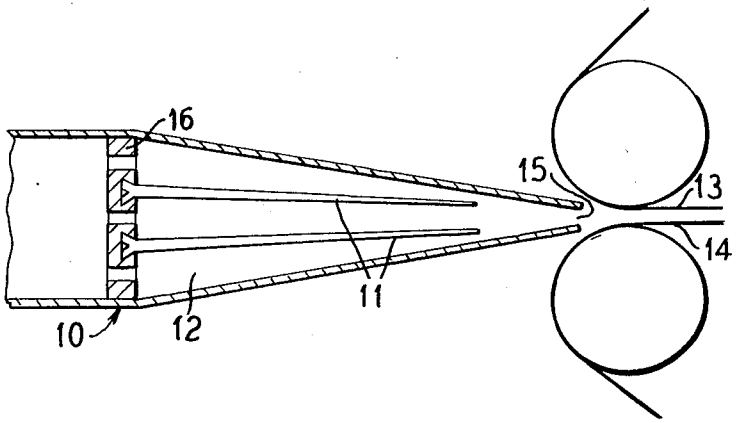
FIG. 1 is a somewhat schematic cross-sectional view of the slice chamber of a headbox with trailing elements therein delivering multi-ply stock to the forming section of a papermaking machine.
Figure 2:
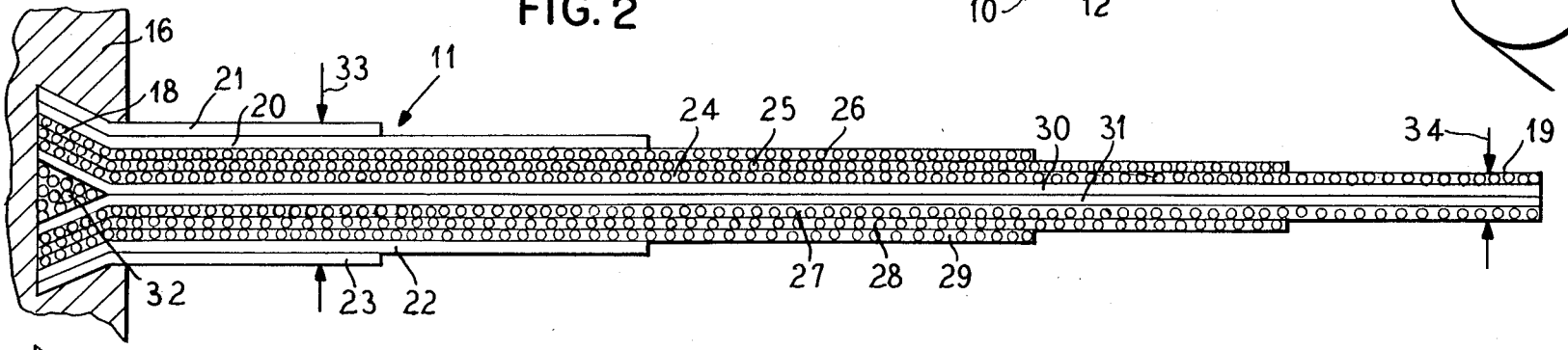
FIG. 2 is an enlarged vertical detailed view illustrating the details of construction of a trailing element constructed and operating in accordance with the principles of the present invention.
Figure 3:
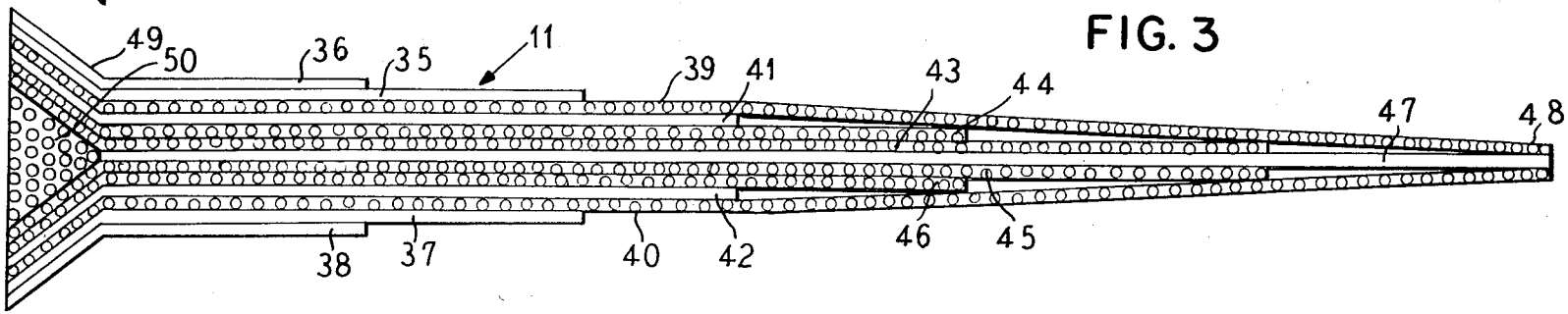
FIG. 3 is a detailed view through a trailing element in accordance with the invention, but constructed in accordance with another form.

As illustrated in FIG. 1, a headbox 10 is provided with a slice chamber 12 to receive stock flowing therefrom. Within the slice chamber are self-positionable trailing elements 11 which extend preferably from pondside to pondside and are anchored at their upstream end in a wall 16 with openings therethrough. The stock flows from the headbox through the openings in the wall and through the tapering slice chamber to a slice opening 15 to a forming section shown as being formed between a pair of converging traveling forming wires 13 and 14. FIGS. 2 and 3 illustrate details of preferred forms of trailing elements 11 constructed and operating in accordance with the principles of the invention.

Principally, the arrangements of FIGS. 2 and 3 provide a trailing element utilizing anisotropic construction as disclosed in the co-pending application, Ser. No. 555,158. Herein, the concept optimizes each part of the sheet separately by using directionally oriented layers of material and thicknesses of the material to obtain varied mechanical and hydraulic properties in various positions within the sheet. Since the outermost portions of the structure are most important to their strength and stiffness, the position thickness and material properties and orientation are used in combination to optimize sheet performance. In the arrangement of FIG. 2, at the upstream end 18 of the sheet or element 11, outer layers 20 and 21 on one side of the element and similar outer layers 22 and 23 are used in the sandwich. These layers are preferably of a material such as graphite (or others) with the fibers extending in the machine direction. As illustrated in the drawing, the layers with fibers extending in the cross-machine direction will be shown with the small circles to indicate the ends of the fibers, and layers with the fibers in the machine direction will be shown as clear to indicate the fibers extending in the machine direction. The innermost of the two outer layers which have fibers in the machine direction is longer than the outer layer, that is, layers 20 and 22 are longer than layers 21 and 23. This provides that the upstream or early portion of the sheet will have the highest thickness and will also have machine direction dominant fibers on the outer plies for maximized strength to withstand shut-down forces and loss of pressure in one chamber of a multi-strata headbox, while still maintaining pressure in one or more other chambers, plus maximum stiffness to dampen large scale turbulence.

Proceeding inwardly, the sheet of FIG. 2 is illustrated with the next three layers 24, 25 and 26 on the upper side and 27, 28 and 29 on the lower side having the fibers in the cross-machine direction. Also, the innermost layer 24 and 27 is the longest extending all the way to the tip 19 of the element, and the next layer 25 and 28 is the next longest, whereas the outermost layer of the layers having fibers in the cross-machine direction, namely 26 and 29 is of less length. This construction is consistent with providing a region near the tip 19 which has greater stiffness in a cross-machine direction to minimize instability due to lack of stiffness in the cross-machine direction. That is, the downstream portion of the sheet has a dominance of cross-machine fibers on the outside of the sheet. This maximizes cross-machine stiffness to reduce buckling. The predominance of cross-direction fibers on the outer portion of the sheet as well as less thickness maximizes cross-direction stiffness while it minimizes machine direction stiffness for the tip to be able to conform to streamlines putting minimal disturbances in the flow.

The innermost layers 30 and 31 extend the full length of the sheet and have fibers in the machine direction.

The thin tip with minimal machine direction stiffness yet maximal cross-machine stiffness for maximized cross-direction profile stability and minimized flow disturbance for reduced eddy generation is accomplished. This allows for the use of maximum length sheets or elements with minimal tip gap for maximum formation capability and minimum turbulence, minimum eddy generation and ability to follow streamlines and allows minimum disturbance for multistrata sheets, contributing to layer purity.

The sheet tip thickness as shown by the dimension 34 will be preferably in the range of 0.010" to 0.020" thickness. The upstream thickness as illustrated by the dimension lines 33 will be on the order of preferably being 0.080" to 0.100", although it may be more depending upon the length of the element.

At the very upstream end 18, the sheet is supported in the wall 16 by an enlarged bead. The bead is formed by flaring out the layers and providing a filler 32. The filler is added in a single wedge to prevent collapse. The filler is preferably formed with cross-machine direction fibers to minimize cross-machine thermal expansion.

The foregoing principles are utilized in the arrangement of the structure of FIG. 3. In FIG. 3 the outermost layers 35 and 36 for the upper surface of the sheet and 37 and 38 for the lower surface are arranged similar to FIG. 2 with the outermost layers 36 and 38 being slightly shorter than the next layers 35 and 37. These layers have the fibers running in a machine direction. The next sheet 39 has the fibers running in the cross-machine direction with the layer at the top being shown at 39 and at the bottom shown at 40, although these layers in this construction extend for the full length of the sheet to the tip 48.

The next layer inwardly is shown at 41 and 42 and is shortened with the fibers extending in the machine direction.

The next layers proceeding in an inward direction are 43 and 44 for the upper portion of the sheet and 45 and 46 for the lower with the innermost layers 43 and 45 extending almost to the tip and the layers immediately outwardly 44 and 46 being somewhat shorter. These layers have the fibers extending in a cross-machine direction.

The innermost core of the sheet is formed of a single layer 47 with the fibers extending in a machine direction, and this layer extends also for the full length of the sheet.

At the head end of the sheet 49, the layers are flared outwardly with an inner core 50 having fibers in a cross-machine direction.

In operation, the sheets will be fitted either singly or in multiple arrangements in the slice chamber of a headbox. Stock will flow through the slice chamber with the uppermost portion of the elements 11 being of maximized strength due to the layered arrangement where there are an increased number of layers in the upstream direction and the layers additionally have the fibers extending in the machine direction. Proceeding toward the downstream end, the elements 11 have a greater stiffness in the cross-machine direction and diminish in thickness and have a greater flexibility in the machine direction. Thus, it will be seen that we have provided an improved trailing element structure for a papermaking machine which meets the objectives and advantages above set forth and provides for improved stock flow and control of turbulence for improved formation in the forming section of the paper machine.

We claim as our invention:

1. A paper machine element for use in a headbox for delivering stock to a forming surface, the headbox having a slice chamber and a slice opening, the element comprising:

a trailing element for positioning in a slice chamber for stock flow induced movement;

said element to extend transversely of the headbox and having a greater structural strength and stiffness in the machine directin than in the cross-machine direction at an upstream end and having a greater structural stiffness in the cross-machine direction than in the machine direction at a downstream end to minimize instability so that the element resists deflection in the cross-machine direction by transient pressure variations and offers low resistance to deformation in the fluid flow stream for balancing pressure forces on opposite sides of the element;

and means for anchoring said element in the slice chamber at the upstream end with the downstream end to be unattached and constructed to be self-positionable so as to be responsive to forces exerted therein by the stock flowing over the surfaces of the element.

2. A paper machine element for use in a headbox for delivering stock to a forming surface, the headbox having a slice chamber and a slice opening, the element constructed in accordance with claim 1:

wherein the construction of the element includes fibers laminated into the element with the fibers at the upstream end extending in the machine direction and the fibers at the downstream end extending in the cross-machine direction.

3. A paper machine element for use in a headbox for delivering stock to a forming surface, the headbox having a slice chamber and a slice opening, the element constructed in accordance with claim 2:

wherein the element is formed of a lamination of materials with said fibers on an outer surface of the element.

4. A paper machine element for use in a headbox for delivering stock to a forming surface, the headbox having a slice chamber and a slice opening, the element constructed in accordance with claim 1:

wherein the element tapers to a thin tip at the downstream end.

5. A paper machine element for use in a headbox for delivering stock to a forming surface, the headbox having a slice chamber and a slice opening, the element constructed in accordance with claim 4:

wherein the downstream tip thickness is in the range of 0.010" to 0.020".

6. A paper machine element for use in a headbox for delivering stock to a forming surface, the headbox having a slice chamber and a slice opening, the element constructed in accordance with claim 4:

wherein the upstream end has a thickness of at least in the range of 0.080" to 0.100".

7. A paper machine element for use in a headbox for delivering stock to a forming surface, the headbox having a slice chamber and a slice opening, the element constructed in accordance with claim 1:

wherein the element is formed of laminations of materials with the upstream end having cross-machine direction fibers as an inner layer to minimize cross-machine thermal expansion.

8. A paper machine element for use in a headbox for delivering stock to a forming surface, the headbox having a slice chamber and a slice opening, the element constructed in accordance with claim 1:

wherein the upstream end is formed of a plurality of layers with the layers arranged for maximized stiffness to dampen large scale turbulence in the headbox.

9. A paper machine element for use in a headbox for delivering stock to a forming surface, the headbox having a slice chamber and a slice opening, the element comprising:

a trailing element for positioning in a slice chamber for a stock flow induced movement;

said element to extend transversely of said headbox and having a greater structural stiffness in the machine direction than in the cross-machine direction at an upstream end for maximized strength and maximized stiffness to dampen large scale turbulence and greater structural stiffness in the cross-machine direction than in the machine direction at a downstream end;

and means for anchoring said element in a slice chamber at an upstream portion with the downstream portion unattached and constructed to be self-positionable so as to be responsive to forces exerted thereon by the stock flowing over the surfaces of the element.

10. A paper machine element for use in a headbox for delivering stock to a forming surface, the headbox having a slice chamber and a slice opening, the element constructed in accordance with claim 9:

and being formed with a lamination of fibers with the fibers extending in the machine direction at the upstream end.

11. A paper machine element for use in a headbox for delivering stock to a forming surface, the headbox having a slice chamber and a slice opening, the element comprising:

a trailing element for positioning in a slice chamber for stock flow induced movement;

said element to extend transversely of the headbox and being formed of laminations of materials of differing structural strengths;

said laminations arranged so that the cross-machine direction strength is less than the machine direction strength at an upstream end of said element and the cross-machine direction strength is greater than the machine direction strength at a downstream end of said element;

and means for anchoring said element in a slice chamber at an upstream portion with a downstream portion unattached and constructed to be self-positionable so as to be responsive to forces exerted thereon by stock flowing over the surfaces of the element.

12. A paper machine element for use in a headbox for delivering stock to a forming surface, the headbox having a slice chamber and a slice opening, the element constructed in accordance with claim 11:

wherein said element is flexible.

13. A paper machine element for use in a headbox for delivering stock to a forming surface, the headbox having a slice chamber and a slice opening, the element comprising:

a trailing element for positioning in a slice chamber for stock flow induced movement;

said element formed of a plurality of layers of material laminated to each other of different lengths with substantially all of the layers being present at an upper end of the element and fewer layers being present at a lower trailing end of the element, giving said element a greater structural strength in the machine direction than in the cross machine direction at the upper end and a greater structural strength in the cross machine direction than in the machine direction at the lower trailing end;

and means for anchoring said element in a slice chamber at an upstream portion with the downstream portion unattached and constructed to be self-positionable so as to be responsive to forces exerted thereon by stock flowing over the surfaces of the element.

14. A paper machine element for use in a headbox for delivering stock to a forming surface, the headbox having a slice chamber and a slice opening, the element constructed in accordance with claim 13:

with the layers on an outer surface of the element being shorter.

15. A paper machine element for use in a headbox for delivering stock to a forming surface, the headbox having a slice chamber and a slice opening, the element constructed in accordance with claim 13:

with outer layers of the element having fibers extending in the machine direction and certain layers inwardly from the outer layers having fibers extending in the cross-machine direction.

16. A paper machine element for use in a headbox for delivering stock to a forming surface, the headbox having a slice chamber and a slice opening, the element constructed in accordance with claim 13:

with an innermost layer of the element having fibers extending in the machine direction and layers outwardly therefrom having fibers extending in the cross-machine direction.

17. A paper machine element for use in a headbox for delivering stock to a forming surface, the headbox having a slice chamber and a slice opening, the element constructed in accordance with claim 16:

and outermost layers having fibers extending in the machine direction.

* * * * *